United States Patent [19]

Fitch et al.

[11] 3,931,715

[45] Jan. 13, 1976

[54] METHOD OF TRANSPORTING ICE STRUCTURE

[75] Inventors: John L. Fitch; Lloyd G. Jones, both of Dallas, Tex.

[73] Assignee: Mobil Oil Corporation, New York, N.Y.

[22] Filed: July 5, 1974

[21] Appl. No.: 486,251

[52] U.S. Cl. ..... 61/46.5; 61/46

[51] Int. Cl.[2] ..... E02D 19/04; F25C 1/02

[58] Field of Search ..... 61/46, 46.5, 34, 1 R, 63, 61/50; 62/64, 259; 166/DIG. 1

[56] References Cited

UNITED STATES PATENTS

| | | | |
|---|---|---|---|
| 2,939,290 | 6/1960 | Crake | 61/46.5 |
| 3,380,255 | 4/1968 | Schroeder | 61/34 |
| 3,738,114 | 6/1973 | Bishop | 61/34 |
| 3,750,412 | 8/1973 | Fitch et al. | 61/46 |

*Primary Examiner*—Dennis L. Taylor
*Attorney, Agent, or Firm*—C. A. Huggett; Drude Faulconer

[57] ABSTRACT

This specification discloses a method of providing an ice structure at a desired offshore, frigid location. The structure is constructed at a first offshore location by accumulating ice on a base of naturally occurring ice. The existing extreme temperature is utilized to quickly freeze water sprayed or flooded on the base to form the accumulating ice. The base sinks under the weight of the accumulated ice to form the structure having a desired thickness. A cavity is then formed, preferably by melting, in the interior of the structure to provide the structure with sufficient buoyancy to float the structure and allow it to be towed to its desired location. There the cavity is filled with a material dense enough to again cause the structure to sink and become grounded at said desired location.

8 Claims, 3 Drawing Figures

METHOD OF TRANSPORTING ICE STRUCTURE

BACKGROUND OF THE INVENTION

This invention relates to a method of providing a structure made primarily of ice at a desired location and more particularly relates to a method of transporting an offshore ice structure from a first frigid area where it is constructed to another frigid area where said structure is to be used.

In producing hydrocarbons from hostile, frigid environments, e.g., Arctic shelf, many problems are encountered which are not normally present in other offshore areas. These problems arise from the ever-changing ice conditions in these areas. For example, in winter "fast ice" may attach itself to shore and extend outward as much as 50 miles in places. Such ice could serve as a temporary, stable platform for drilling or other operations but, unfortunately, this ice breaks up during the thawing period and "shore-leads" of open water develop through the ice. While the leads are open, floating drilling operations might be carried out but the risk is great since pack ice frequently moves shoreward under the influence of winds and currents. When this happens, the pack ice can completely close the shore-leads, thereby damaging any equipment within the leads. Further, this pack ice, which may range up to ten feet or more in thickness, can exert massive force which may be too great to be resisted by any practical drilling/production fixed platform of the conventional type. Therefore, to operate successfully in these areas, any drilling/production structure must be capable of withstanding or avoiding the force of the moving pack ice.

One structure which can successfully resist such forces is an island which extends upward from an anchored position on the marine bottom to a distance above the waterline. Ideally, this island would be a naturally occurring one but unfortunately such islands are not normally present in this area or are located in the wrong places to serve a particular field. It follows that in most instances if an island is to be used, it must be of some other form.

At least three alternate forms of such islands have been proposed: (1) artificial islands built of earth materials and the like; (2) natural ice islands; and (3) artificial ice islands. As to artificial earth islands, the severe shortage or difficulty of obtaining the required materials in the Arctic areas makes their use impractical in most of these areas. The use of natural ice islands in these areas has been investigated as reported in OIL AND GAS JOURNAL, July 28, 1969, pp. 118–119, but these attempts were abandoned due to severe cracking of the islands. A further difficulty is that natural ice islands are unlikely to be present at the desired location and time. This leaves artificial ice islands to which the present invention relates.

In U.S. Pat. No. 3,750,412, issued Aug. 7, 1973, there is fully described a method of constructing an artificial ice island by utilizing the naturally occurring freezing temperatures found in certain frigid areas. An ice floe or a portion of fast ice is selected as a base on which ice is accumulated by freezing water which is sprayed or flooded onto said base. The base under the added weight of the accumulated ice will begin to sink toward the marine bottom. Accumulation of ice is continued until the structure attains a desired thickness.

The areas having the extreme temperatures necessary for the rapid freezing of water to form such structures, however, are not always the same areas as those where said structures are ultimately to be used. Furthermore, in some areas where such structures are to be used, movement of pack ice is such that it is virtually impossible to anchor an ice floe or the like over an exact location and maintain that position while an island is being constructed. Therefore, for use of such structures to be practical, there is a need for a method of constructing an ice structure in an area best suited for this purpose and then economically transporting it to the location where it is to be used.

SUMMARY OF THE INVENTION

The present invention provides a method whereby an ice structure may be transported from one offshore area to another.

An artificial ice island is first constructed in a frigid offshore area where the temperature is such to allow the rapid freezing of water to accumulate ice at a practical rate necessary to form said island. For actual techniques that may be used to form such an island, see U.S. Pat. No. 3,750,412, issued Aug. 7, 1973. In accordance with the present invention, once the island is formed, an internal cavity is provided therein, preferably by melting a portion of the ice forming the island. This melting can be accomplished by circulation of a hot fluid or can be done in situ by supplying fuel and air to the interior of the island and igniting same. As the cavity increases and the resulting water is removed, the remaining island shell becomes buoyant and will begin to float. When the proper buoyancy is attained, the melting is ceased and the island shell can then be towed to its desired location. If the island is formed from fast ice, it may be necessary to wait for the thawing season so that the remaining fast ice is broken up before the island is transported. Also, protection from marginal melting should be provided during the time the island is being towed.

Once the island reaches its destination, the internal cavity is filled to overcome the buoyancy of the island shell and the ice island is grounded in position, ready for use. A wide range of materials having a proper density can be used to fill the cavity. For example, sand, gravel, or other dredged materials can be used or water or crushed ice can be supplied to the cavity and frozen into a solid mass by refrigeration equipment.

The above mentioned and other advantages of the invention will be more readily appreciated as the invention becomes better understood by reference to the following detailed description when considered in connection with the accompanying drawings wherein:

DESCRIPTION OF THE PREFERRED EMBODIMENTS

In constructing an ice island, a base having the desired surface area, e.g., about one acre or greater, is first selected. This base may be a relatively flat sheet of ice, such as an ice floe, or may be a larger ice mass, such as an iceberg, or it may be a portion of fast ice attached to the shore. The base is hopefully captured in the immediate region where the island is to be constructed but if it is normally floating ice, it can be towed by a tug or the like to the desired construction location. The base is anchored at the construction location and construction of the island is commenced.

The construction location is in an area having extremely low temperatures which are necessary for the rapid freezing of water as it is sprayed or flooded on the base. The ice formed will accumulate on the base and the weight thereof will cause the base and accumulated ice to sink. Accumulation of ice is continued until the island attains a desired thickness. For a more detailed description of the actual construction of ice islands including spraying and flooding techniques along with reinforcing and protection steps for said islands, reference is again made to U.S. Pat. No. 3,750,412, issued Aug. 7, 1973.

Once an island has been formed and it is not to be used at the position where is was constructed, an internal portion of the ice is removed, preferably by melting. As a cavity is formed within the island, the remaining ice shell will attain sufficient buoyance to cause the shell to float on the surface. Lines can then be attached to the ice shell so that it may be towed to a location where it is to be used. When said location is reached, the buoyant cavity in the island shell can be filled with a dense material (e.g., sand, or other material dredged from the marine bottom) or it can be filled with crushed ice and/or water which is then frozen by refrigeration equipment. By filling the cavity, buoyancy of the shell will be overcome and the island will sink to become grounded at the desired location.

Figure 1:
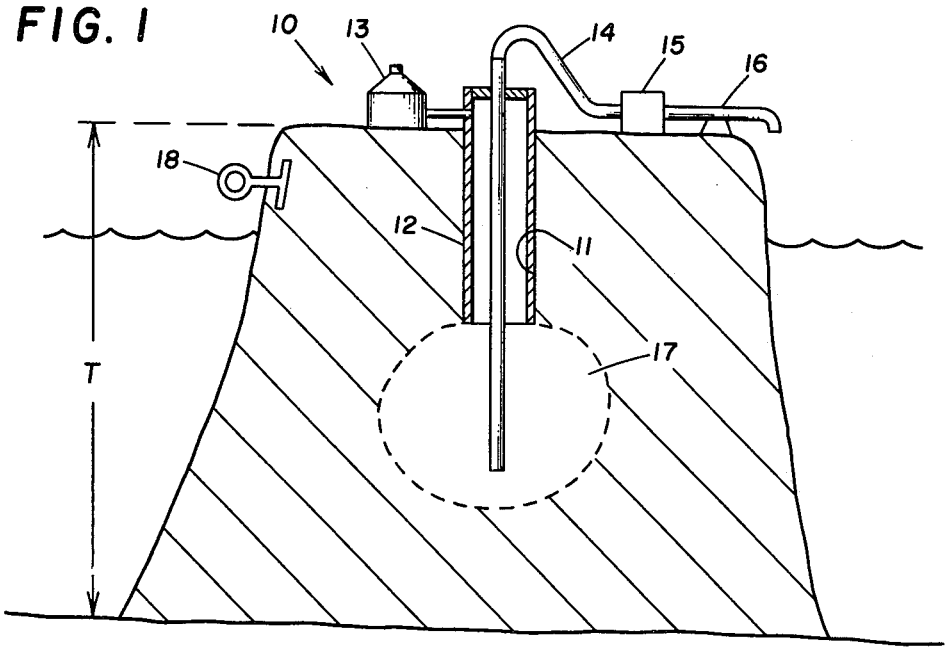
FIG. 1 is a sectional view of an ice island utilizing a first technique for forming an internal cavity therein.

The method of the present invention will now be further described by referring to the drawings. In FIG. 1, ice island 10 has been constructed in an Arctic area having the temperatures required for the rapid freezing of water when water is flooded or sprayed onto a selected ice base. Once again, the actual construction of island 10 including reinforcement techniques and means for protecting said island during thawing periods is fully described in U.S. Pat. NO. 3,750,412. Island 10 has achieved the desired thickness T, this thickness being that which is required for island 10 to extend from the marine bottom to a point above the waterline when the island is grounded in the area where the island is ultimately to be used.

A hole 11 is drilled or otherwise provided in island 10 and casing 12 is positioned therein. The interior of casing 12 is connected to boiler or heater 13 which supplies steam or other hot fluid to casing 12. Suction pipe 14 is slidably positioned within casing 12 and is connected to a suction pump 15.

After casing 12 is in position, hot fluid is supplied to the interior thereof and flows down into contact with the ice at the lower end of casing 12. As the hot fluid melts the ice, suction pipe 14 which is heated in part by the incoming hot fluid, picks up the resulting water and expels it off island 10 through pump 15 and outlet 16. Suction pipe 14 is slidable within casing 12 so that the inlet of pipe 14 can be maintained near the bottom of ever-expanding cavity 17 in order to remove the water before it has a chance to refreeze. Also, the exposed portions of pipe 14 and pump outlet 16 need to be well insulated to prevent the expelled water from freezing therein.

Although the dotted lines in FIG. 1 represent that cavity 17 is spheric in configuration, it should be recognized that the actual configuration is not critical and may actually take an irregular shape within the island. The main criteria are that cavity 17 remain completely within island 10 (not break through the sides of island 10) and that it be large enough to provide the buoyancy necessary to float the shell of island 10 which remains after cavity 17 has been formed.

Figure 3:
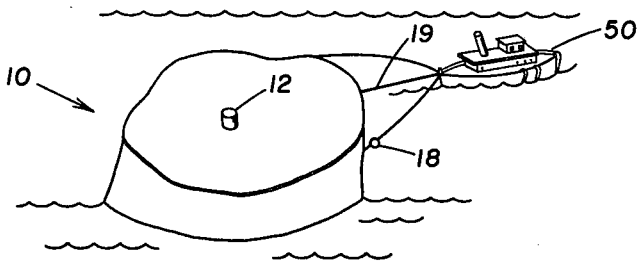
FIG. 3 is a perspective view of a vessel towing an ice island to a desired location.

After cavity 17 is large enough so that island 10 has the desired buoyancy, melting is stopped and island 10 is allowed to float. If island 10 has been formed from fast ice, it may be necessary to wait until the thawing season for the surrounding fast ice to break up to allow the island to be towed to its desired location. Suction pipe 14, boiler 13, and related equipment may be removed but casing 12 is preferably capped and left in place to provide a means for refilling cavity 17 when island 10 has been finally positioned. Towing anchors 18 or the like may be frozen into the island or otherwise provided as a means for attaching towlines 19 from tug 50 to island 10 (see FIG. 3).

Insulative means such as described in U.S. Pat. No. 3,750,412 can be provided for island 10 to prevent marginal melting as island 10 is towed to its new location. Once island 10 has reached its destination, cavity 17 can be refilled with gravel, sand, or other dredged materials or it can be filled with crushed ice and/or water which is then frozen into a solid mass by artifical refrigeration or the like. As cavity 17 is filled, island 10 loses its buoyancy and sinks to become grounded at its desired location.

Figure 2:
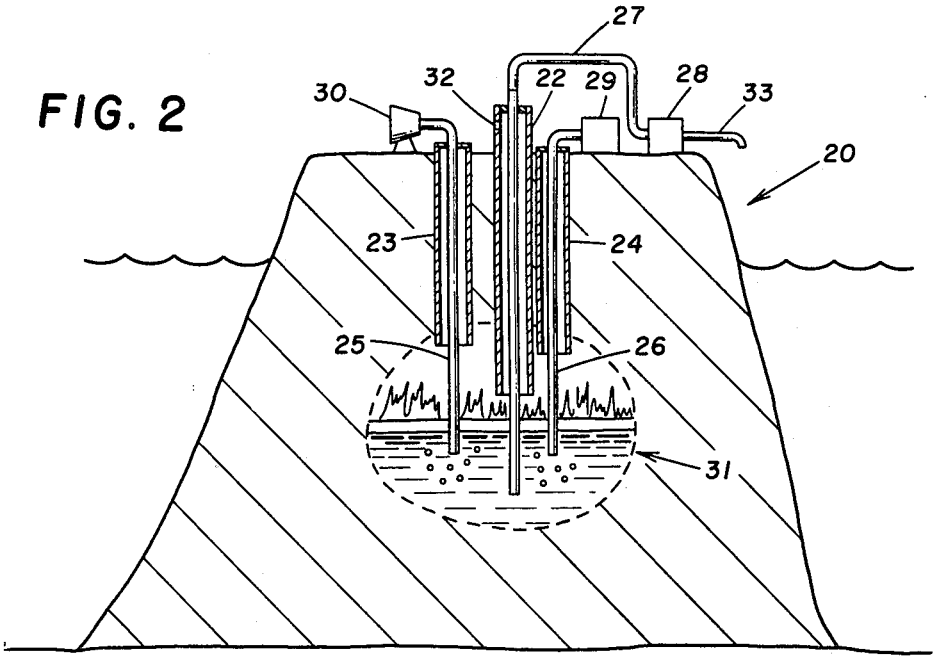
FIG. 2 is a sectional view of an ice island utilizing a second technique for forming an internal cavity therein.

In FIG. 2 an alternate method of forming a cavity in an ice island is illustrated. A hole is drilled or otherwise provided in island 20 in which casing 22 is positioned. A small initial cavity is reamed out just below casing 22 and conduits 23 and 24 are placed into communication with said initial cavity. Air line 25 and fuel line 26 are slidably positioned within conduits 23 and 24, respectively. Suction line 27 is slidably positioned within casing 22 and is connected to suction pump 28.

With the equipment in place as shown in FIG. 2, fuel, e.g., oil, is supplied by pump 29 to cavity 31 through line 26 and air is supplied by compressor 30 through line 25. The fuel and air mixture is ignited within cavity 31 and the resulting heat begins to melt the ice and enlarge cavity 31. The exhaust gases from the combustion will rise through the annulus between casing 22 and suction line 27 and are vented through vent 32 in casing 22. The warm exhaust gases also heat suction line 27 to aid in preventing the water being removed from cavity 31 from refreezing. Lines 25, 26, and 27, all of which are fire resistant, e.g., stainless steel, are lowered within cavity 31 as melting progresses. Oil and air, being lighter than water, will surface through any accumulated water in cavity 31 to feed the combustion within said cavity. Water, as it accumulates from melted ice, is quickly removed through line 27 and expelled from island 20 through pump 28 and outlet 33.

When cavity 31 reaches a size necessary to supply the desired buoyancy, the combustion in cavity 31 is extinguished and the related equipment is removed. Conduits 23 and 24 can be removed or sealed but conduit 22 is capped to provide a means for refilling cavity 31 when island 22 reaches its final destination. The island can then be towed and positioned as described above. Again, although cavity 31 has been illustrated as spherical, it should be recognized that is actually may take an irregular shape in many instances. Although two methods of providing an internal cavity in an ice island have been described, it should be recognized that other techniques could be used. For example, the cavity could be formed mechanically by drilling and reaming operations. Also, while a single, centrally located cavity has been illustrated, buoyancy for the island could be provided by forming several smaller internal cavities positioned about the island. If this latter technique were used, preferably the cavities would be formed in communication with each other so that they could all be filled through a common inlet.

What we claimed is:

1. A method of transporting an ice island from a first offshore location to a second offshore location, said method comprising:

forming an internal cavity within said ice island of a size sufficient to provide the buoyancy necessary for said island to float on the water at said first offshore location, said internal cavity being formed within said structure by melting ice from the interior of said structure and removing the resulting water; and moving said island on the water from said first offshore location to said second offshore location.

2. The method of claim 1 wherein said melting is carried out by circulating hot fluids into the interior of said ice structure.

3. The method of claim 1 wherein said melting is carried out by supplying fuel and air to the interior of said structure and igniting said mixture.

4. A method of providing an ice structure at a desired frigid, offshore location, said method comprising:

constructing said structure at a first, frigid, offshore location where the atmospheric temperature is such that water exposed to the air will rapidly freeze to supply the ice necessary to form said structure;

providing an internal cavity within said ice structure of a size necessary to provide sufficient buoyancy to cause said structure to float, said internal cavity being formed within said structure by melting ice from the interior of said structure and removing the resulting water;

transporting said ice structure from said first, offshore location to said desired frigid, offshore location; and filling said cavity with a material dense enough to cause said structure to lose its buoyancy and sink to become grounded at said desired frigid location.

5. The method of claim 4 wherein said melting is carried out by circulating hot fluids into the interior of said ice structure.

6. The method of claim 4 wherein said melting is carried out by supplying fuel and air to the interior of said structure and igniting said mixture.

7. The method of transporting an ice island from a first offshore location to a second offshore location, said method comprising:

providing a hole from the surface of the island to the interior thereof;

supplying hot fluid through said hole to melt ice in the interior of said island;

removing the water resulting from said melting of said ice and expelling said water from said island;

continuing said melting and said water removal until an internal cavity is formed which provides said island with sufficient buoyancy to allow said island to float;

ceasing said supply of hot fluid and capping said hole in said island; and moving said island to said second offshore location.

8. The method of claim 7 including:

refilling said cavity through said hole after said island is at said second offshore location, said cavity being refilled with material having a density great enough to cause said island to lose its buoyancy.

* * * * *